United States Patent [19]

Crise

[11] 4,195,601

[45] Apr. 1, 1980

[54] CONTROLLED COMPRESSION INTERNAL COMBUSTION ENGINE HAVING FLUID PRESSURE EXTENSIBLE CONNECTING ROD

[76] Inventor: George W. Crise, P.O. Drawer A, Danville, Ohio 43014

[21] Appl. No.: 955,924

[22] Filed: Oct. 30, 1978

[51] Int. Cl.[2] ..... F02B 75/04

[52] U.S. Cl. ..... 123/78 E; 123/48 B

[58] Field of Search ..... 123/48 R, 48 B, 78 R, 123/78 AA, 78 E, 78 F

[56] References Cited

U.S. PATENT DOCUMENTS

| | | | |
|---|---|---|---|
| 1,506,540 | 8/1924 | Matson | 123/78 E |
| 1,560,492 | 11/1925 | Powell | 123/78 E |
| 1,610,137 | 12/1926 | Kratsch | 123/78 E |
| 1,637,245 | 7/1927 | Scully | 123/78 E |
| 1,747,091 | 2/1930 | Trbojeuich | 123/78 E |
| 1,872,856 | 8/1932 | Walher | 123/78 F |
| 2,134,995 | 11/1938 | Anderson | 123/48 B |
| 2,217,721 | 10/1940 | Anthony | 123/78 E |
| 2,252,153 | 8/1941 | Anthony | 123/78 E |
| 2,372,472 | 3/1945 | Cambell | 123/78 E |
| 2,989,954 | 6/1961 | Hulbert | 123/48 B |
| 4,124,002 | 11/1978 | Crise | 23/78 E |
| 4,131,094 | 12/1978 | Crise | 123/78 E |
| 4,140,091 | 2/1979 | Showers | 123/78 E |

*Primary Examiner*—Charles J. Myhre
*Assistant Examiner*—Jeffrey L. Yates
*Attorney, Agent, or Firm*—William S. Rambo

[57] ABSTRACT

A reciprocating piston-type internal combustion engine is equipped with a variable length connecting rod which is operable in response to engine oil pump pressures to cause a low throttle fuel charge to be compressed in the engine cylinder to substantially the same pressure as an open throttle fuel charge. An adjustable pressure regulator valve is provided to insure a substantially constant oil pressure at the connecting rod at all times during operation of the engine.

2 Claims, 5 Drawing Figures

FIG. 4
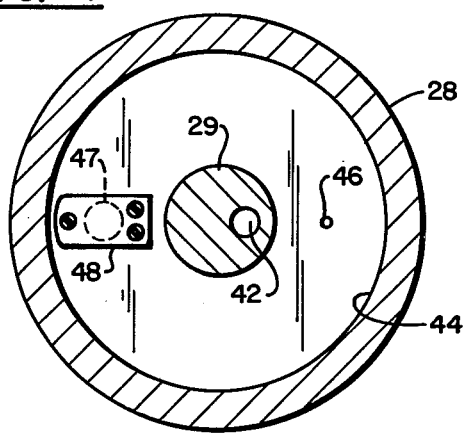
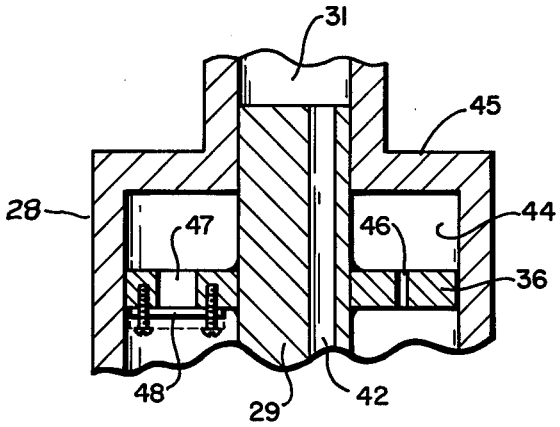
FIG. 5

CONTROLLED COMPRESSION INTERNAL COMBUSTION ENGINE HAVING FLUID PRESSURE EXTENSIBLE CONNECTING ROD

CROSS-REFERENCE TO RELATED APPLICATION

The invention described and claimed in this application is an improvement upon the invention described and claimed in my copending application for U.S. Letters Patent Ser. No. 746,462 filed Dec. 1, 1976 entitled "Pressure-Responsive, Variable Length Connecting Rod," now U.S. Pat. No. 4,124,002 issued Nov. 7, 1978.

BACKGROUND OF THE INVENTION

This invention relates generally to reciprocating piston-type internal combustion engines, and more particularly to internal combustion engines having variable length connecting rods operable to change the head space above the engine pistons.

In my prior, copending application Ser. No. 746,462, I disclose an internal combustion engine having a pressure-responsive, variable length connecting rod which is operable to lengthen in response to the induction of a relatively low pressure fuel charge into the associated engine cylinder and to shorten in response to the attainment of a given high pressure within the engine cylinder during compression of the fuel charge therein. The relative lengthening or shortening of the connecting rod of my aforesaid prior application was accomplished by utilizing the engine crankshaft as a valve to control the supply and discharge of oil to and from a hydraulic pressure chamber in the connecting rod.

While the mode and principle of operation of the variable length connecting rod disclosed in my prior application Ser. No. 746,462 was sound, its structure was unnecessarily complicated by the presence of pressure relief valves within the connecting rod structure, and its efficiency was somewhat reduced by fluctuations in engine oil pressure.

SUMMARY AND OBJECTS OF THE INVENTION

The present invention provides an improved internal combustion engine having a variable length connecting rod comprising relatively telescoping sections arranged to define between them one or more hydraulic pressure chambers into and from which oil under a substantially constant pressure may be introduced or discharged only during the last portion of the compression stroke of the engine. The connecting rod will thus lengthen in the presence of a relatively low pressure fuel charge within the engine cylinder, or shorten in the presence of a relatively high pressure fuel charge, thereby insuring substantial uniformity of compression regardless of the pressure characteristics of different fuel charges inducted into the engine cylinder.

According to this invention, the pressure-responsive connecting rod is provided with a single oil inlet-outlet port arranged to communicate with the usual lubricating oil passage formed in the throw journal of the engine crankshaft only when the crankshaft throw and piston closely approach a top dead center position, so that oil under pressure may be either introduced into or exhausted from the hydraulic pressure chamber(s) of the connecting rod to either lengthen or shorten the rod according to the pressure within the engine cylinder during the last part of the compression stroke of a two cycle engine and the last part of both the compression and exhaust strokes in the case of a four cycle engine. An adjustable pressure regulator valve is used in combination with a high pressure engine-driven oil pump to supply oil to the oil passage of the connecting rod and thence to the inlet-outlet port of the pressure-responsive connecting rod. The regulator valve is preferably equipped with a pressure control lever or member mechanically linked with the automatic spark advance mechanism of the engine and/or a manual control, whereby the pressure of the oil at the inlet-outlet port of the connecting rod may be varied in accordance with changes of engine speed and fuel octane ratings.

The primary object of this invention is to provide an improved oil pressure-operated connecting rod which automatically varies in length in accordance with the pressure of the fuel charge being compressed in the engine cylinder, thereby attaining uniformity of compression regardless of the influent pressure of the fuel charge.

Additional objects and advantages will become more readily apparent from the following description of the preferred embodiment of the invention.

BRIEF DESCRIPTION OF THE DRAWINGS

FIG. 4 is a horizontal sectional view taken along the line 4—4 of FIG. 2; and FIG. 5 is an enlarged, detailed sectional view taken through the dash pot piston of the variable length connecting rod.

DESCRIPTION OF THE PREFERRED EMBODIMENT OF THE INVENTION

Figure 1:
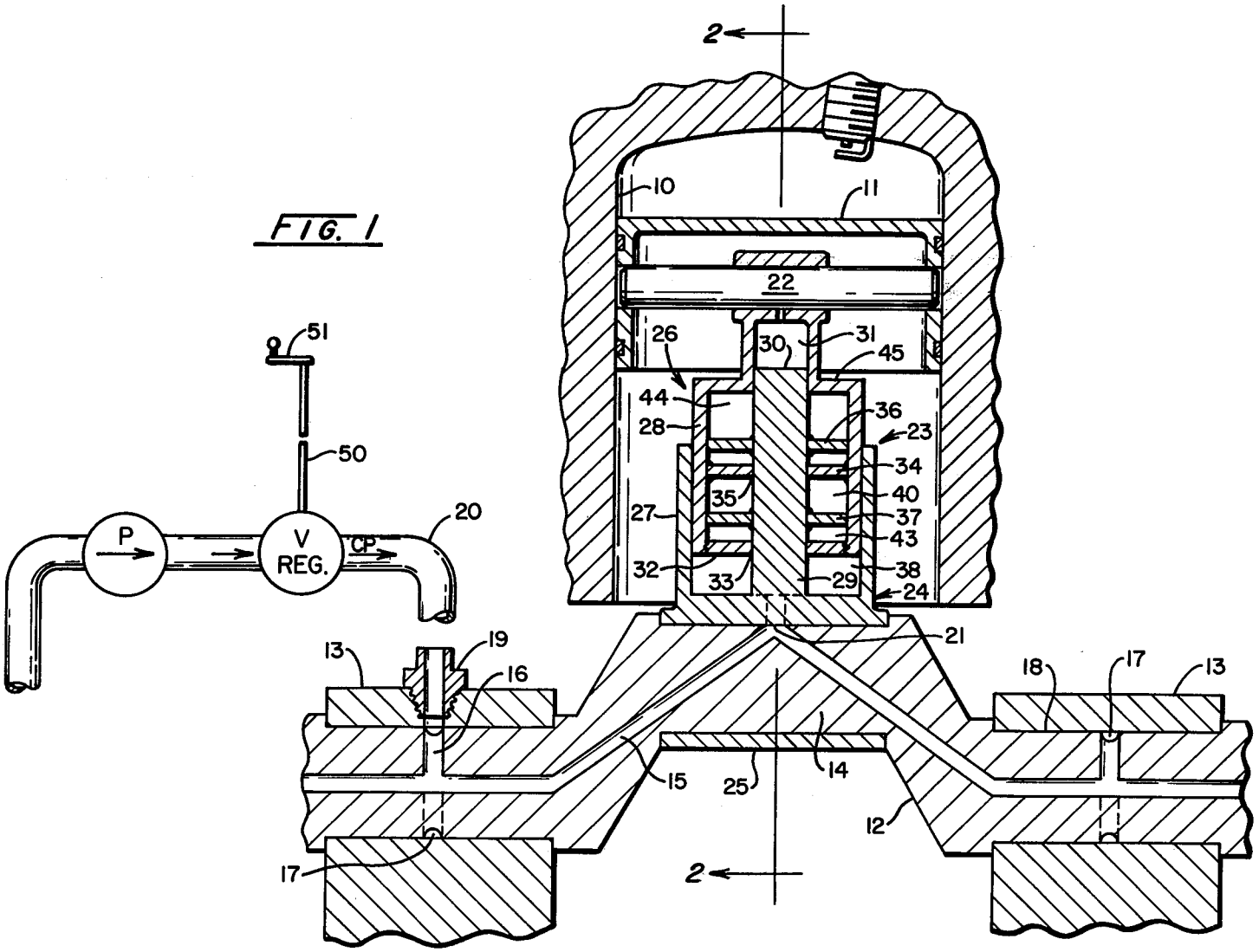
FIG. 1 is a cross-sectional view taken through a portion of the crankshaft, connecting rod, piston and cylinder of a controlled compression engine according to this invention and illustrating diagrammatically the oil pump and adjustable pressure regulator valve for supplying oil under regulated pressure to the oil passage of the crankshaft.

With reference to the drawing, my invention is embodied in an internal combustion engine which includes a conventional combustion cylinder 10, into which a gaseous fuel-air mixture may be introduced, compressed and burned, an engine piston 11 reciprocable in the cylinder 10, and a crankshaft 12 mounted for axial rotation in relatively stationary bearings 13. The crankshaft 12 is formed with an eccentric throw journal 14 and a longitudinally extending oil passage 15 having radial branches 16 communicating with annular grooves or ports 17 formed in the main journals 18 of the crankshaft. As usual, one of the main bearings 13 of the engine is equipped with an oil inlet fitting 19 having a through passage communicating with the annular groove 17 formed in the adjacent main journal 18 of the crankshaft 12. An oil supply pipe or conduit 20 is connected to supply oil under pressure from an engine-driven pump P to the inlet fitting 19 and thence to the oil passage 15 of the crankshaft. The oil passage 15 of the crankshaft is formed with an outlet port 21 which opens radially outwardly of the throw journal 14 of the crankshaft. The piston 11 is provided with the usual wrist pin 22 which is journalled in the upper end of a pressure-responsive, variable length connecting rod indicated generally by reference numeral 23.

According to this invention, the connecting rod 23 includes a base section 24 rotatably secured to the throw journal 14 of the crankshaft 12 by a detachable, stirrup-shaped bearing segment 25, and a plunger section 26 rotatably secured to the wrist pin 22 of the piston 11. The base section 24 of the connecting rod includes an outwardly opening barrel portion 27 which slidably receives a close fitting, hollow skirt portion 28 of the plunger section 26. The base section 24 also includes a central, axially extending column or stabilizer post 29 whose outer end portion 30 telescopes within a relatively short cylindrical bore 31 formed in the outer, wrist pin-adjoining end portion of the plunger section 26.

The skirt portion 28 of the plunger section 26 is closed by an annular piston-forming wall 32 which is provided with a central bearing opening 33 disposed in wiping engagement with the stabilizer post 29. The skirt portion 28 is also provided with an intermediate, annular, piston-forming wall 34 having a central bearing opening 35 slidably embracing the post 29. The annular piston-forming walls 32 and 34 are preferably brazed, welded, or threadedly connected with the skirt portion 28 and are movable therewith.

The central column or stabilizer post 29 includes a pair of axially spaced apart, radially extended, annular walls 36 and 37. Each of the walls 36 and 37 has an outer circumferential edge disposed in wiping engagement with the inner wall surface of the skirt portion 28 of the plunger section 26. The annular piston wall 32 of the plunger section 26 thus defines with the barrel portion 27 of the base section of the connecting rod a first hydraulic pressure chamber 38 into and from which oil may be introduced or discharged by way of an inlet-outlet passage 39 formed in the base section 24 of the connecting rod. The annular piston wall 34 of the plunger section 26 defines with the relatively stationary wall 37 of the post 29 a second hydraulic pressure chamber 40 into and from which oil may be introduced and discharged by way of an inlet-outlet passage 41 formed in the post 29.

The post 29 is also formed with a substantially unrestricted fluid passage 42 which extends between the bore 31 of the plunger section 26 and an annular chamber 43 formed between the wall 32 of the skirt portion 28 of the plunger section 26 and the radially extended wall 37 of the post 29.

Figure 3:
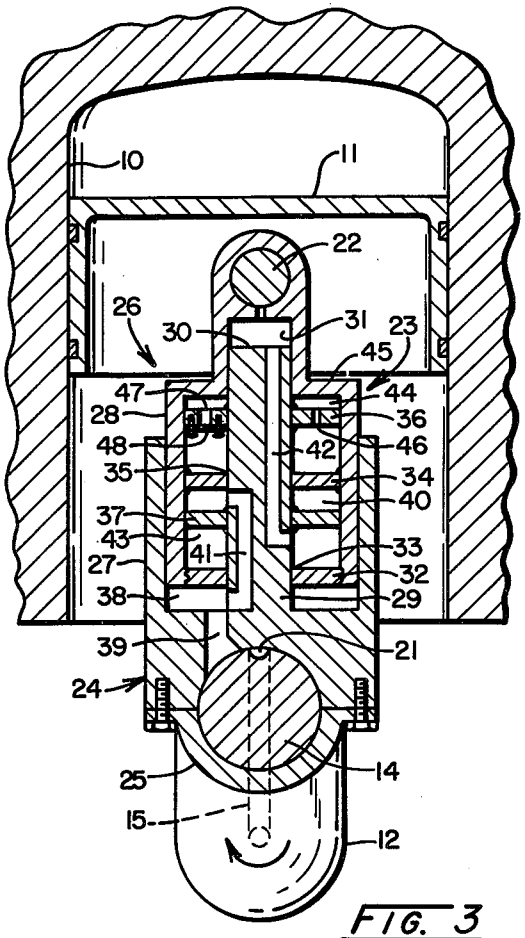
FIG. 3 is a similar view, but showing the variable length connecting rod in a relatively retracted condition.
Figure 2:
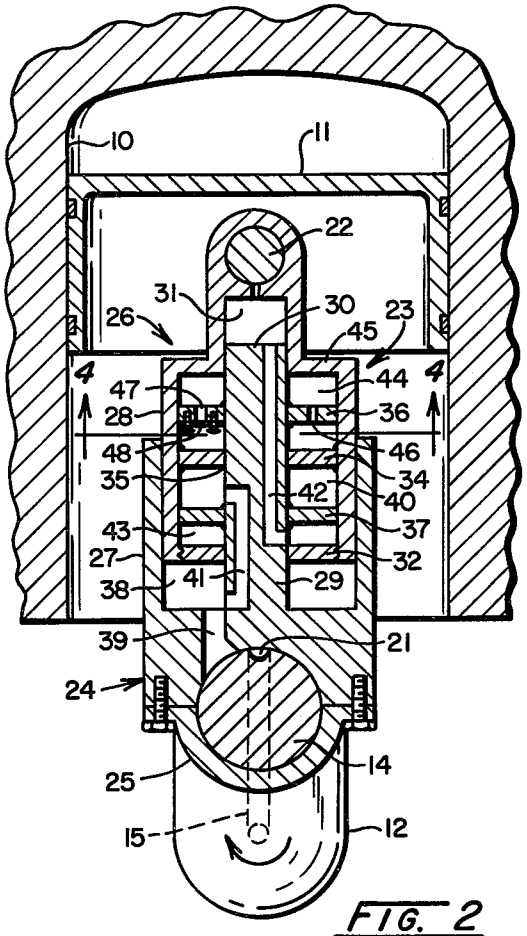
FIG. 2 is a vertical sectional view taken approximately along the line 2—2 of FIG. 1 and showing the variable length connecting rod in a relatively extended condition.

As shown more particularly in FIGS. 2 and 3, the radially extended wall 36 of the post 29 is disposed in an annular dash pot chamber 44 formed between the upper wall 45 and the piston wall 34 of the skirt portion 28. The wall 36 is formed on one side of the post 29 with a relatively restricted through opening or orifice 46 and on the other side of the post with a substantially larger, unrestricted through passage 47. A poppet or flapper-type check valve 48 is mounted on the lower face of the wall 36 adjacent the passage 47 and is arranged to either open or close the passage 47 in response to an imbalance of fluid pressures on opposite sides of the wall 36.

Connected in the oil supply pipe 20 between the outlet of the pump P and the inlet fitting 19 is an adjustable pressure regulator valve V having a remotely extending, rotary control shaft or cable 50. The control shaft or cable 50 may, if desired, be connected with the conventional automatic spark advance mechanism (not shown) of the engine and may be equipped with a manual control lever 51, so that the pressure of oil passing through the valve V may be adjusted for different engine speeds, fuel octane rating, etc.

OPERATION

In operation, oil under pressure of the pump P, as regulated by valve V, is present at all times in the passage 15 of the crankshaft 12. The inlet-outlet port 39 formed in the base section 24 of the connecting rod 23 is normally closed by the outer cylindrical surface of the crankshaft throw journal 14 except when the outlet port 21 of the throw journal moves into communication with the port 39. The port 39 is preferably arranged so it will be brought into communication with the outlet port 21 of the throw journal 14 as the throw journal 14 reaches a position approximately 30° before top dead center (BTDC) and will remain in communication until approximately 5° BTDC. In this manner, the hydraulic pressure of the pump P, as regulated by valve V, is transmitted through port 39 into the pressure chamber 38, and through passage 41 of the central port 29 into the second pressure chamber 40. Thus, pump pressure acting on the piston walls 32 and 34 of the plunger section 26 of the connecting rod is opposed by the pressure acting upon the engine piston 11. If the total forces acting on the plunger section 26 of the connecting rod 23 are greater than the forces acting on the head surface of the engine piston 11, the plunger section will move axially outwardly relative to the base section 24 to thus increase the overall length of the connecting rod and thereby force the piston farther toward the cylinder head of the engine. Conversely, if the force acting against the head surface of the engine piston is greater than the force acting to extend or lengthen the connecting rod, the plunger section will retract into the base section of the connecting rod until such forces are equalized.

It will thus be seen that by properly proportioning the total areas of the pressure-responsive piston walls of the plunger section of the connecting rod to the area of the head surface of the engine piston, the pressure of the pump P may be balanced against the pressure of gases being compressed in the engine cylinder during the last portion of the compression stroke of both two and four cycle engines, and also during the last portion of the exhaust stroke of a four cycle engine.

As will be evident, the number of hydraulic pressure chambers and pressure-responsive piston faces or walls on the plunger section of the connecting rod may be varied according to the desired diameter or size of the connecting rod in relation to an optimal pump pressure, so that the total force acting to extend or lengthen the connecting rod will be balanced against the total force acting upon the head surface of the engine piston when an optimum firing pressure is reached within the gaseous fuel charge within the engine cylinder at or near the firing or ignition point of the cylinder.

As previously indicated, the radially extended wall 36 of the post 29 and the upper cylindrical chamber 44 of the plunger section function in the manner of a dash pot to retard extension or lengthening movement of the connecting rod while permitting free retraction or shortening movement thereof. Thus, when forces act to extend the plunger section 26, oil within the lower part of the dash pot chamber 44 must pass through the restricted orifice 46 to reach the upper part of the chamber 44. Conversely, when forces act to retract the plunger section 26, oil is free to flow from the upper part of the chamber 44 through the opened check valve 48 into the lower part of the chamber 44. The fluid passage 42 of the central post is substantially unrestricted in size, to provide a substantial balance in pressure between the chamber 43 and the bore 31 of the upper plunger section 26.

Thus, as indicated by a comparison between FIGS. 2 and 3, the present variable length connecting rod 23 will shorten substantially instantaneously toward the end of a compression stroke in response to the compression of a comparatively dense, open-throttle fuel charge in the engine cylinder, but will lengthen only incrementally on the compression stroke in response to a less dense, closed-throttle fuel charge. However, in the case of a four-cycle engine, the connecting rod will also lenghten incrementally during the last portion of the exhaust stroke due to the relatively low pressure of the burned gases being expelled from the engine cylinder during the exhaust stroke and while the inlet-outlet port 39 of the connecting rod is in communication with the oil passage outlet 21 of the crankshaft throw journal.

The capability of the connecting rod to substantially instantaneously shorten in response to a build-up in pressure to or beyond the optimum pressure within the engine cylinder during the last portion of the compression stroke minimizes the chances of detonation and dangerously high cylinder head pressures at the point of firing the compressed fuel charge. At the same time, the ability of the connecting rod to incrementally lengthen in response to sub-optimal pressures within the cylinder during the latter parts of both the compression and exhaust strokes of a four-cycle engine greatly increases the relatively closed or low throttle operating efficiency of the engine and the exhaust gas scavenging ability of the engine.

By providing the pressure regulator valve V with the adjustable pressure control 50, the output pressure of the valve V may be varied either manually or mechanically to proportionately vary the optimum compression of fuel charges in the engine cylinder. For example, when the engine is operating on a comparatively low octane-rated fuel, the "optimum" pressure on the fuel charge at the time of firing should be comparatively less than that of a higher octane-rated fuel charge. In such instance, the control lever 51 might be manually adjusted to reduce the pressure of oil in the oil passage of the crankshaft.

The remotely disposed pressure control lever 51 may also be linked to a conventional automatic spark-advance or other engine speed-responsive control, not shown, so that the pressure of the oil in the oil passage 15 of the crankshaft will automatically be lowered with an increase of engine speed and a consequent increase in the inertial force acting on the engine piston.

In view of the foregoing, it will be seen that this invention provides a controlled, substantially constant compression internal combustion engine in which the attained pressure of the fuel charge in the engine cylinder is measured and balanced against a substantially constant pressure of oil displaced by a pressure regulated, engine driven oil pump. Thus, the oil pump which is normally used to supply oil under pressure to the crankshaft and connecting rod bearings of the engine may be utilized in combination with an adjustable pressure regulator valve to also supply the hydraulic pressure required for operation of the variable length connecting rod.

While a single preferred embodiment of the invention has been illustrated and described in detail, it will be obvious that various modifications in design and details of construction are possible without departing from the spirit of the invention as defined by the following claims.

I claim:

1. In an internal combustion engine which includes: a combustion cylinder into which combustible gases may be introduced, compressed and burned; an engine piston in said cylinder; a crankshaft having a throw journal and an oil passage which includes an outlet port opening radially outwardly of said throw journal; pump and valve means connected to supply oil under regulated pressure to the oil passage of said crankshaft; and a variable length connecting rod including relatively extensible and retractable sections connected between said piston and the throw journal of said crankshaft and defining in said connecting rod a plurality of relatively communicating hydraulic pressure chambers into which oil under pressure may be introduced to lengthen said connecting rod and from which oil may be discharged to shorten said connecting rod; that improvement which comprises:

(a) an inlet-outlet passage in said connecting rod in continuous communication with said hydraulic pressure chambers and arranged to communicate with the oil outlet port of the throw journal of said crankshaft only when the throw journal occupies a position slightly in advance of a top dead center position, said connecting rod closing the oil outlet port of the throw journal in all other rotative positions of the throw journal; and (b) dash pot means in said connecting rod arranged to retard the relative extension of the sections of said connecting rod while permitting free retraction thereof.

2. An internal combustion engine according to claim 1, wherein said dash pot means comprises a closed chamber in one of the sections of said connecting rod and a piston carried by the other section of said connecting rod and reciprocable in said closed chamber, said last-named piston including a restricted orifice extending therethrough and a check valve arranged therein to permit unrestricted flow of fluid therethrough in one direction only.

* * * * *